US007198357B2

(12) United States Patent
Tanikawa

(10) Patent No.: US 7,198,357 B2
(45) Date of Patent: Apr. 3, 2007

(54) INK EJECTING HEAD AND METHOD FOR MAKING THE SAME

(75) Inventor: Toru Tanikawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 285 days.

(21) Appl. No.: 10/770,798

(22) Filed: Feb. 3, 2004

(65) Prior Publication Data

US 2006/0132545 A1 Jun. 22, 2006

(30) Foreign Application Priority Data

Feb. 6, 2003 (JP) ..... P2003-030125

(51) Int. Cl.
*B41J 2/05* (2006.01)

(52) U.S. Cl. ..... 347/61; 347/58

(58) Field of Classification Search ..... 347/56–59, 347/61

See application file for complete search history.

(56) References Cited

U.S. PATENT DOCUMENTS 4,942,408 A * 7/1990 Braun ..... 347/63
6,616,269 B2 * 9/2003 Nozawa ..... 347/58

* cited by examiner

*Primary Examiner*—An H. Do
(74) *Attorney, Agent, or Firm*—Sonnenschein Nath & Rosenthal LLP

(57) ABSTRACT

An ink ejecting head includes a nozzle sheet having nozzles for ejecting droplets; a head chip having an energy generator opposing each of the nozzles; a barrier layer interposed between the nozzle sheet and the head chip for forming the space for a liquid chamber; a pad provided in a surface of the head chip, the surface opposing the nozzle sheet; and a wiring layer disposed on a surface of the nozzle sheet, the surface adjacent to the head chip; and a bump disposed on the wiring layer, being at least in contact with the pad of the head chip, and bonded to the pad by ultrasonic bonding.

8 Claims, 9 Drawing Sheets

INK EJECTING HEAD AND METHOD FOR MAKING THE SAME

RELATED APPLICATION DATA

The present application claims priority to Japanese Application(s) No(s). P2003-030125 filed Feb. 6, 2003, which application(s) is/are incorporated herein by reference to the extent permitted by law.

BACKGROUND OF THE INVENTION

1. Field of the Invention

The present invention relates to ink ejecting heads incorporated in, for example, inkjet printers, and also relates to methods for making the ink ejecting heads. In particular, the present invention relates to an ink ejecting head having no opening on a nozzle sheet for bonding to a head chip and no constraints on the height of a liquid chamber, and also relates to a method for making the ink ejecting head for appropriate bonding of the head chip without raising the production costs.

2. Description of the Related Art

A known ink ejecting head for inkjet printers requires an electrical connection between a head chip having an energy generator for applying energy to ink for ejecting ink droplets, and a printed circuit board controlling the actuation of this head chip.

A known method for establishing the electrical connection therebetween is to connect each terminal of both the head chip and the printed circuit board by wire bonding (see, for example, Japanese Examined Patent application Publications Nos. 6-4325 (in particular, FIGS. 3 and 5) and 6-4329 (in particular, FIG. 7)).

In particular, FIG. 3 of the former document (hereinafter referred to as "Patent Document 1") shows that lead electrodes 12 of a discharge element 7 (corresponding to the head chip) and electrodes 15 of a substrate 14 (corresponding to the printed circuit board) are bonded together by wire bonding.

In the known method described above, however, the structure of the ink ejecting head requires that wire bonding between the head chip and the printed circuit board be performed on the surface from which ink droplets are ejected (in FIG. 3 of Patent Document 1, on the surface having orifices 9 from which ink is ejected).

To perform wire bonding, openings must be formed on a member having nozzles (orifices) and must be sealed with, for example, resin (in FIG. 3 of Patent Document 1, openings are sealed with sealing agent 17) on completion of the wire bonding. This involves many production processes and thus an increase in production costs.

Moreover, as shown in FIG. 3 of Patent Document 1, the sealing agents are projected from the ink ejecting surface for ensuring insulation and mechanical strength.

The projections may cause feeding problems (such as jamming) of a printing medium or may scratch the printing medium, since the printing medium such as paper slides over the ink ejecting surface. Therefore, the openings to be sealed must be away from the path where the printing medium slides over.

SUMMARY OF THE INVENTION

Accordingly, an object of the present invention is to perform bonding of a head chip in the process of producing an ink ejecting head, without forming openings for bonding on a nozzle sheet, without suffering from constraints on the distance between the head chip and the nozzle sheet, without sacrificing reliability, and without raising the production costs.

The object of the present invention can be achieved by the following.

According to a first aspect of the present invention, an ink ejecting head includes a nozzle sheet having nozzles for ejecting droplets; a head chip having an energy generator opposing each of the nozzles; a chamber-forming member interposed between the nozzle sheet and the head chip for defining the space for a liquid chamber between the energy generator and the nozzle; an electrode provided in a surface of the head chip, the surface opposing the nozzle sheet, and provided in at least a part of an area where no chamber-forming member is disposed; a wiring layer having a first terminal and disposed on a surface of the nozzle sheet, the surface adjacent to the head chip; and a bonding layer disposed on the first terminal of the wiring layer and being at least in contact with the electrode of the head chip; wherein the energy generator applies energy to liquid in the liquid chamber for ejecting the liquid from the nozzle; and wherein the bonding layer and the electrode of the head chip are bonded by ultrasonic bonding.

As described above, the nozzle sheet, the chamber-forming member, and the head chip are stacked in layers. The head chip has the electrode on the surface opposing the nozzle sheet. The nozzle sheet has the wiring layer and the first terminal on the surface opposing the head chip. The bonding layer disposed on the first terminal of the wiring layer is at least in contact with the electrode of the head chip. Then the electrode of the head chip and the bonding layer are bonded by ultrasonic bonding.

The bonding in the electrode of the head chip can thus be made without forming openings for bonding on the nozzle sheet. Further, ultrasonic bonding can be made without providing the bonding layer such as a bump to the head chip, whereas providing it to the nozzle sheet. Moreover, since the bonding layer to the nozzle sheet can be formed by plating, the height of the bonding layer can be adjusted to any level. Since the bonding layer can thus be formed according to the thickness of the chamber-forming member, the thickness of the chamber-forming member, that is, the height of the ink chamber can be adjusted to a desired level.

DESCRIPTION OF THE PREFERRED EMBODIMENTS

Figure 1:
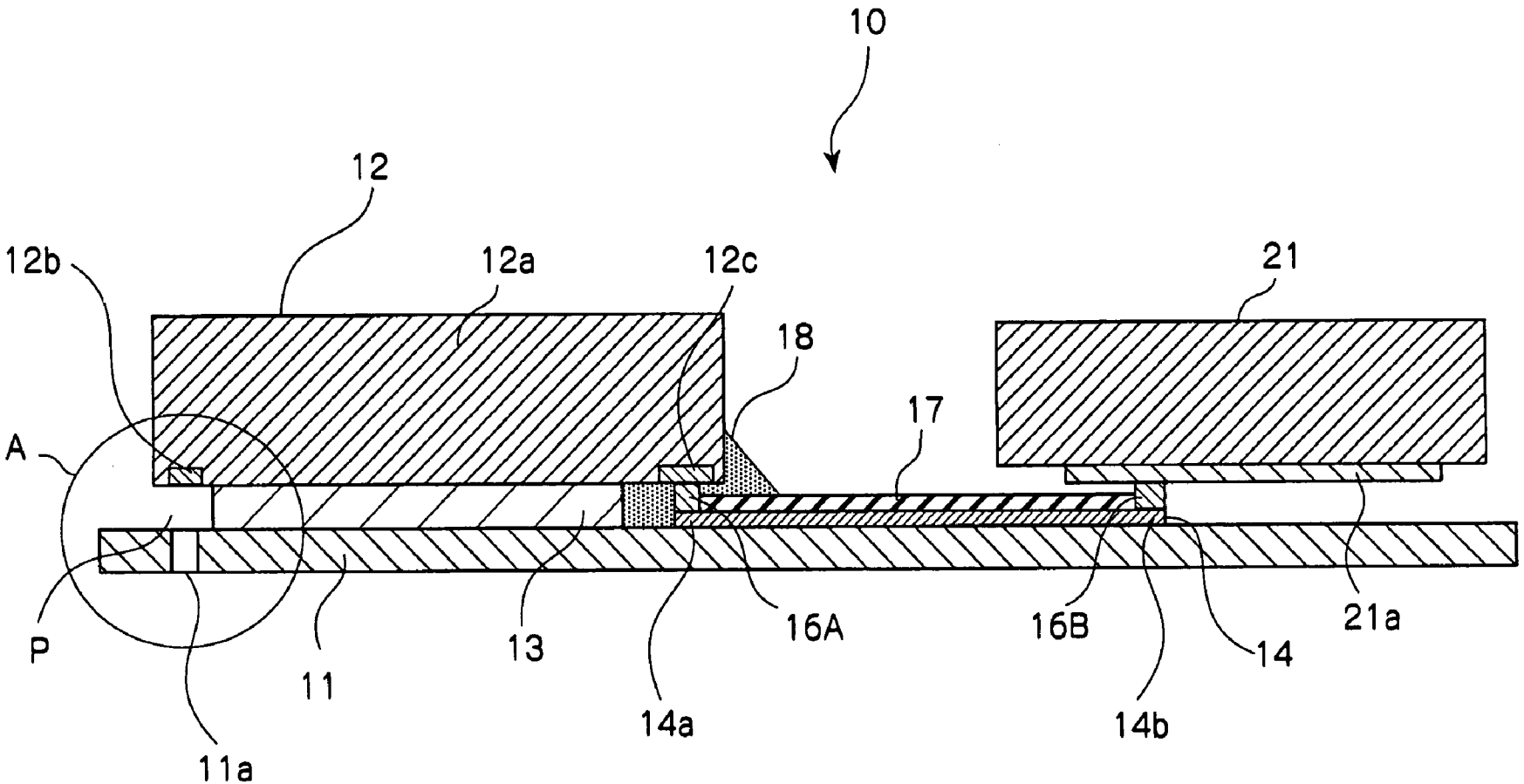
FIG. 1 is a front cross-sectional view of an ink ejecting head according to an embodiment of the present invention.
Figure 2:
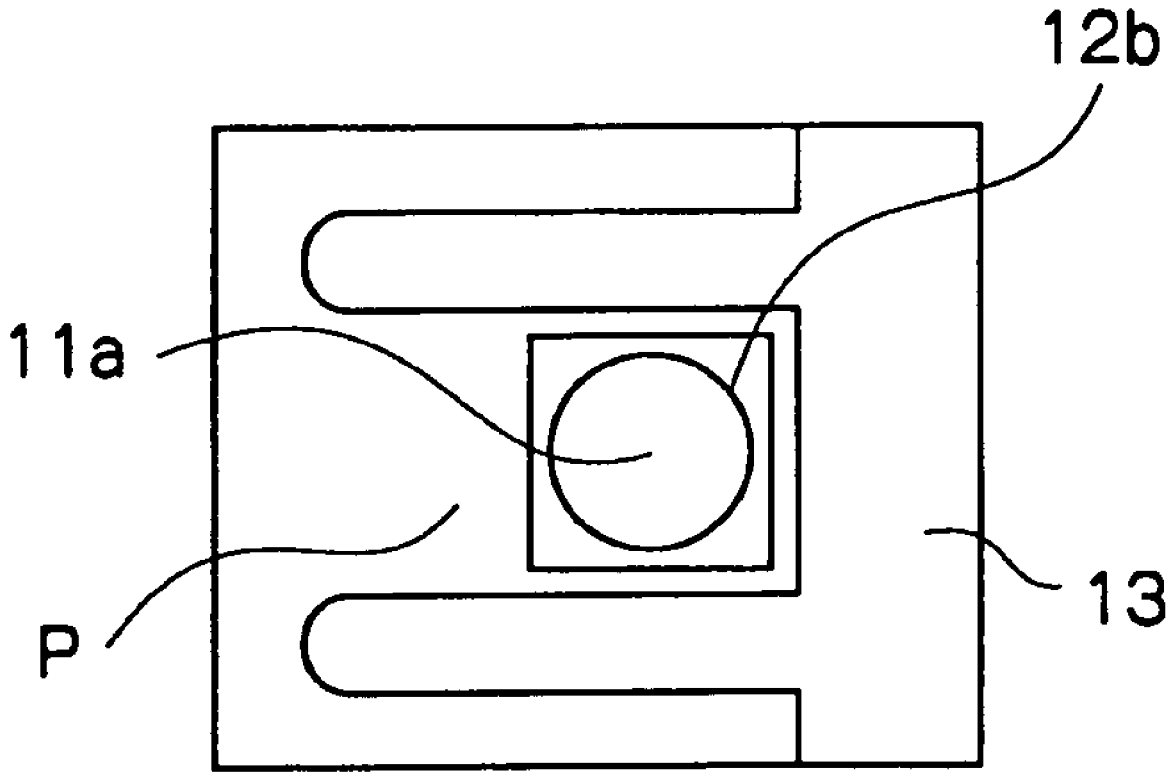
FIG. 2 is a detailed illustration of a section A in FIG. 1, and is a bottom plan view showing a nozzle, an energy generator, and an ink chamber.

An embodiment of the present invention will now be described with reference to the drawings. FIG. 1 is a front cross-sectional view of an ink ejecting head 10 according to an embodiment of the present invention. FIG. 2 is a detailed illustration of the section A in FIG. 1 and is a bottom plan view showing a nozzle 11*a*, an energy generator 12*b*, and an ink chamber P.

Referring to FIG. 1, a nozzle sheet 11 is formed of a flexible printed circuit (FPC) where a circuit is mounted on a flexible film ranging from about 10 to 50 μm in thickness. A wiring layer 14 (conductor) formed of a pattern of copper traces is disposed on the upper (in FIG. 1) surface of the nozzle sheet 11. The wiring layer 14 connects a head chip 12 to a printed circuit board 21 that controls the head chip 12. The wiring layer 14, excluding the areas of a first terminal 14*a* and a second terminal 14*b* (in FIG. 1, both ends of the wiring layer 14), is overlaid with an insulating layer 17 made of the same material as that of the nozzle sheet 11.

The nozzle sheet 11 has a plurality of nozzles 11*a* for ejecting ink droplets.

Further, the nozzle sheet 11 has a barrier layer 13 and the head chip 12 stacked thereon. The head chip 12 has a plurality of the energy generators 12*b* (heating elements in this embodiment) precipitated out on one surface (lower surface in FIG. 1) of a semiconductor substrate 12*a* made of, for example, silicon. The energy generators 12*b* are electrically connected, via the semiconductor substrate 12*a* of the head chip 12, to the printed circuit board 21 that controls the actuation thereof.

The barrier layer 13 serves as a chamber-forming member for defining an ink chamber P and is made of, for example, photosensitive cyclized rubber resist or dry film resist of an exposure hardening type. To form the barrier layer 13, such material is first stacked on the entire surface of the semiconductor substrate 12*a*, the surface on which the energy generators 12*b* are formed. Then, unnecessary parts of the material are removed by a photolithography process to form the barrier layer 13. The barrier layer 13 has adhesiveness with the nozzle sheet 11.

Here, the nozzle sheet 11, the barrier layer 13, and the head chip 12 are bonded together such that the nozzles 11*a* of the nozzle sheet 11 oppose the energy generators 12*b*. That is, the central axes of the nozzles 11*a* and the energy generators 12*b* are collinearly arranged. The ink chamber P is defined by the nozzle sheet 11, the barrier layer 13, and the head chip 12.

As shown in FIG. 2, the ink chamber P surrounds the energy generator 12*b* in a concave form. The head chip 12, the barrier layer 13, and the nozzle sheet 11 serve as a top wall, side wall, and bottom wall of the ink chamber P, respectively. In FIGS. 1 and 2, the left side of the ink chamber P is an open area from which ink is fed.

The thickness of the barrier layer 13, which constitutes the height of the ink chamber P, is adjusted to about 8 to 30 μm. Less thickness of the barrier layer 13 causes unstable ejection of ink droplets, whereas excessive thickness interferes with fine patterning as described below. Therefore, the thickness of the barrier layer 13 preferably ranges from about 8 to 30 μm, and more preferably, from about 10 to 15 μm.

The head chip 12 has a pad (electrode) 12*c* on the surface adjacent to the nozzle sheet 11 (lower surface in FIG. 1). The pad 12*c* is made of aluminum and is provided for connection to the wiring layer 14 disposed on the nozzle sheet 11.

A bump (bonding layer) 16A is disposed on the first terminal 14*a* of the wiring layer 14. At least the top sublayer of the bump 16A is made of gold. The bump 16A and the pad 12*c* of the head chip 12 are bonded together. The area where the pad 12*c*, the bump 16A, and the first terminal 14*a* are connected is sealed with sealant 18 such as resin.

The printed circuit board 21 is provided at a certain distance from the position where the barrier layer 13 and the head chip 12 are stacked on the nozzle sheet 11 as shown in FIG. 1. The printed circuit board 21 has a wiring layer 21*a* on the surface opposing the nozzle sheet 11.

A bump 16B (second bonding layer), which is similar to the bump 16A, is provided on the second terminal 14*b* of the wiring layer 14 disposed on the nozzle sheet 11. The bump 16B and the wiring layer 21*a* disposed on the printed circuit board 21 are bonded together.

Some possible methods for performing bonding to a head chip, without providing openings on a nozzle sheet, will now be described. However, these methods are inappropriate due to some problems described below.

Figure 3:
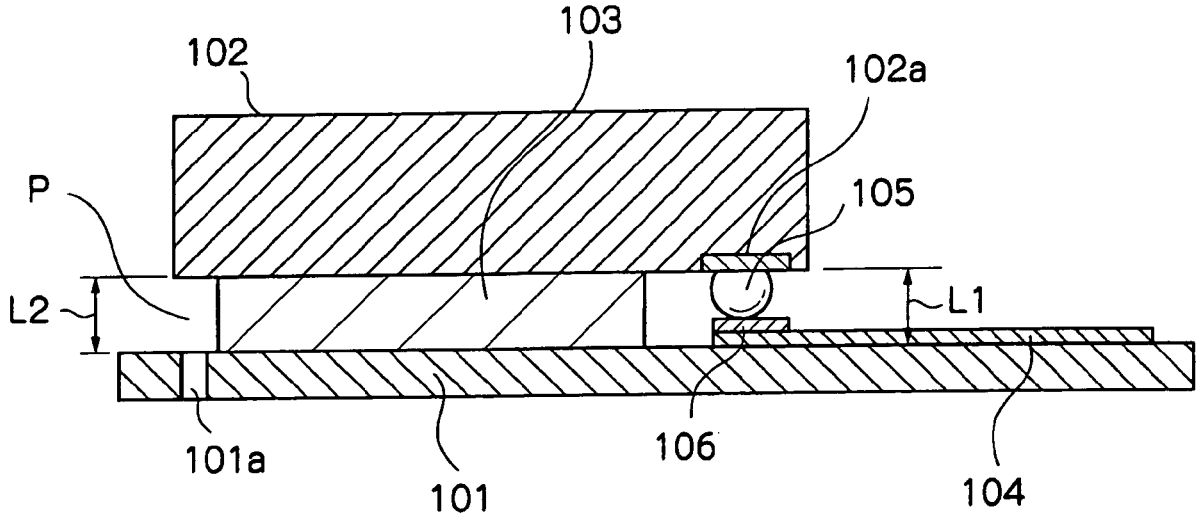
FIG. 3 is a front cross-sectional view showing a possible method for bonding a head chip and a printed circuit board without providing openings.
Figure 4:
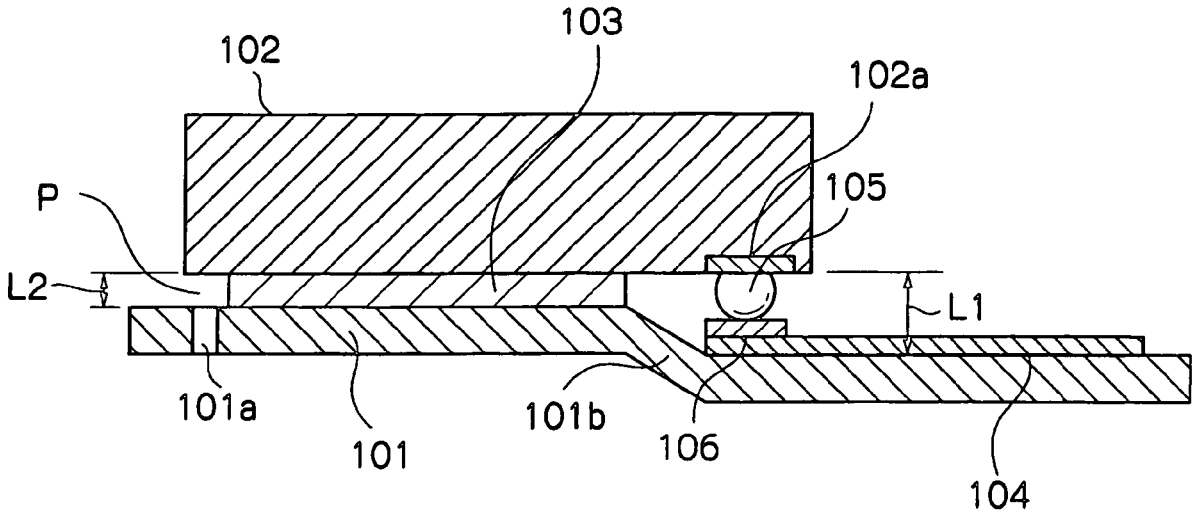
FIG. 4 is a front cross-sectional view showing another possible method for bonding a head chip and a printed circuit board without providing openings.

FIGS. 3 and 4 are front cross-sectional views showing possible methods for bonding a head chip and a printed circuit board without providing openings.

As shown in FIG. 3, a head chip 102 is mounted above a nozzle sheet 101 provided for ejecting ink droplets. The nozzle sheet 101 has no opening, except a nozzle 101*a*, for bonding to the head chip 102. The nozzle sheet 101 is made of FPC. A barrier layer 103 for forming an ink chamber P is interposed between the nozzle sheet 101 and the head chip 102. The head chip 102 and the nozzle sheet 101 are bonded together via the barrier layer 103.

The nozzle sheet 101 has a wiring layer 104 on the surface adjacent to the head chip 102. The head chip 102 has a pad (electrode) 102*a* made of aluminum on the surface adjacent to the nozzle sheet 101. The pad 102*a* of the head chip 102 opposes the wiring layer 104 disposed on the nozzle sheet 101.

To bond the pad 102*a* of the head chip 102 to the wiring layer 104 on the nozzle sheet 101, a ball-shaped stud bump 105 made of gold is formed on the pad 102*a*, whereas a gold-plated layer 106 is formed on the wiring layer 104. The stud bump 105 and the gold-plated layer 106 are then bonded together. The stud bump 105 is formed by adding a ball to a wire bonding process and is used when cost-justified, for example, when points to be bonded are few in number.

The stud bump 105 has a height of, for example, about 65 μm and still has a height of about 25 μm after bonding. Therefore, in FIG. 3, the distance L1 between the head chip 102 and the nozzle sheet 101, which includes the thickness of the wiring layer 104 on the nozzle sheet 101, exceeds 30 μm. The thickness L2 of the barrier layer (ink chamber) 103 is increased (cannot be reduced), accordingly.

In the barrier layer 103 made of, for example, photosensitive resin, its photosensitive properties determine, to a certain extent, the ratio of the thickness of the barrier layer 103 to the pattern width of the ink chamber P. Since, for example, the ratio of the thickness to the width is generally one or less, excessive thickness interferes with the formation of fine patterns. Therefore, the barrier layer 103 has a certain upper limit on thickness to achieve a desired pattern density. The thickness L2 of the barrier layer 103 preferably ranges from about 8 to 30 μm, and more preferably, from about 10 to 15 μm. In the bonding method where the stud bump 105 is formed on the pad 102*a* of the head chip 102, however, limiting the thickness L2 of the barrier layer 103 within these ranges is difficult.

Another method illustrated in FIG. 4 also poses some problems. Referring to FIG. 4, a bend 101*b* is formed in a part of the nozzle sheet 101 to lower the area connecting to the head chip 102. In this case, even if the distance L1 between the head chip 102 and the nozzle sheet 101, which includes the thicknesses of the stud bump 105 and the wiring layer 104, reaches 30 μm or above, the thickness L2 of the barrier layer 103 falls within the range between 10 and 15 μm.

However, it is difficult and undesirable for reliability to rapidly bend the nozzle sheet 101 made of FPC within the length of the head chip 102 (horizontal direction in FIG. 4), which is about 1.6 mm.

Moreover, both methods illustrated in FIGS. 3 and 4 raise the production cost, since the gold-plated layer 106 or the stud bump 105 must be formed on both the wiring layer 104 disposed on the nozzle sheet 101 and the pad 102*a* of the head chip 102.

Alternatively, a bump on the pad 102*a* of the head chip 102 may be formed by plating, instead of forming the stud bump 105, to reduce the height of the bump. To plate the head chip 102, however, resist must be subjected to a masking process prior to the process for plating the bump. This adds complexity to the production process and thus raises the production cost.

For the reasons described above, the bumps 16A and 16B are provided on the wiring layer 14 in the present invention.

The above-described structure disclosed in the present invention enables the head chip 12 and the printed circuit board 21 to be electrically connected via the pad 12*c* of the head chip 12, the bump 16A, the wiring layer 14, the bump 16B, and the wiring layer 21*a*. A signal from the printed circuit board 21 can thus be transmitted to the head chip 12.

Although not shown, the printed circuit board 21 is electrically connected further to a control unit in a main body of a printer.

In the ink ejecting head 10 structured as described above, the energy generators 12*b* are selected according to the instructions from the control unit of the printer, whereas pulsed current based on image data etc. is supplied to the selected energy generators 12*b* for a short period of time such as 1 to 3 μsec. The energy generators 12*b* are thus rapidly heated, and bubbles of ink, which is in the vapor phase, are produced in the vicinity of the energy generators 12*b*. The expansion of the ink bubbles pushes the ink aside.

Then the ink with the same volume as that pushed aside is ejected from the nozzles 11*a* in the form of ink droplets and dropped on the printing paper. That is, the ink in the ink chamber P corresponding to the energy generators 12*b* is ejected from the nozzles 11*a* provided in the bottom wall of the ink chamber P.

Subsequently, the ejected volume of ink is fed from the left side (in FIG. 1), via an ink tank and an ink channel (not shown), into the ink chamber P. The ink chamber P is filled with ink and thus becomes ready for another ejection of ink droplets.

A method for producing the ink ejecting head 10 will now be described.

Figure 5:
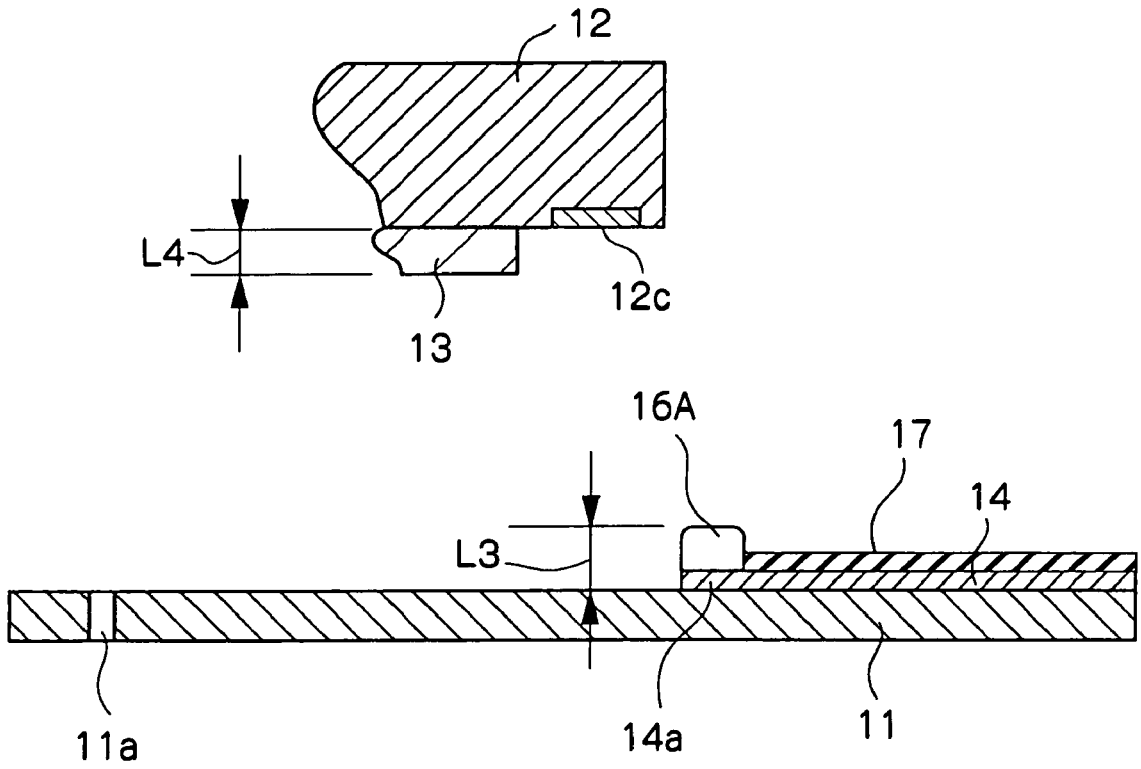
FIG. 5 is a front view showing the state of a head chip and a nozzle sheet before being bonded.

FIG. 5 is a front view showing the state of the head chip 12 and the nozzle sheet 11 before being bonded.

As illustrated, no bump etc. is provided on the pad 12*c* of the head chip 12. On the other hand, the wiring layer 14 is disposed on the nozzle sheet 11. The first terminal 14*a* and the second terminal 14*b* (not shown in FIG. 5) of the wiring layer 14 are exposed, and other parts are covered with the insulating layer 17. The bump 16A is further disposed on the first terminal 14*a*.

Here, the height of the bump 16A (the height L3 in FIG. 5), which is measured from the upper surface of the nozzle sheet 11 and includes the thickness of the wiring layer 14, is set at about 15+α (α is the amount of compression in bonding) μm.

The thickness L4 of the barrier layer 13 disposed under the head chip 12 is set at about 15 μm.

Figure 6:
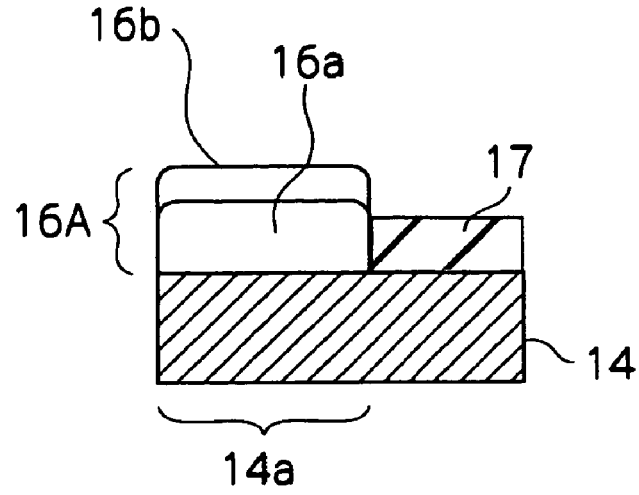
FIG. 6 illustrates layer structures of a bump in detail.

FIG. 6 illustrates the layer structure of the bump 16A in detail. On the first terminal 14*a* of the wiring layer 14, a nickel-plated sublayer (projection) 16*a* is disposed, in consideration of the height mentioned above. A gold-plated sublayer 16*b* is further disposed on the nickel-plated sublayer 16*a*.

Figure 7:
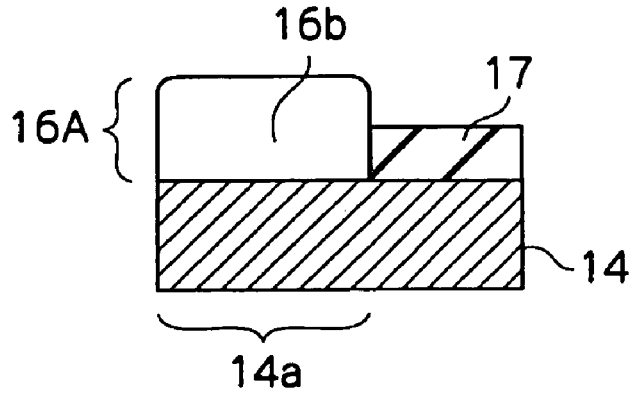
FIG. 7 illustrates another layer structure of a bump (another embodiment), the structure different from that illustrated in FIG. 6.
Figure 8:
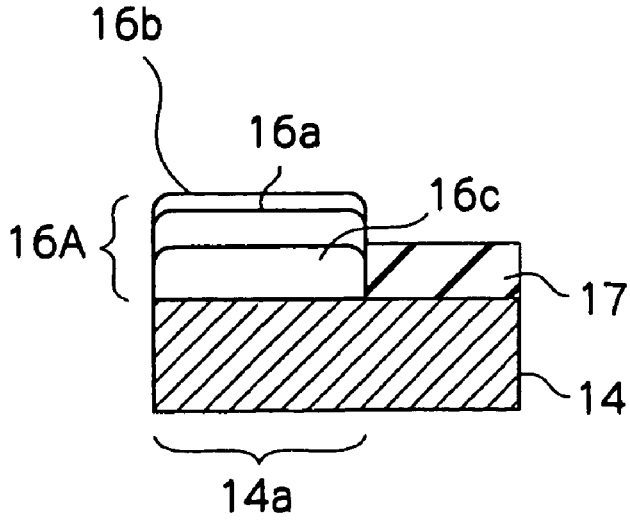
FIG. 8 illustrates another layer structure of a bump (another embodiment), the structure different from that illustrated in FIG. 6.

FIGS. 7 and 8 illustrate other layer structures of the bump 16A (other embodiments), which are different from that illustrated in FIG. 6.

Referring to FIG. 7, the bump 16A is formed on the first terminal 14*a* of the wiring layer 14 such that only the gold-plated sublayer 16*b* constitutes the predetermined height. Referring to FIG. 8, a copper-plated sublayer 16*c* formed of the same material as that of the wiring layer 14 is projected from the first terminal 14*a*. The nickel-plated layer 16*a* and the gold-plated sublayer 16*b* are further disposed on top of the copper-plated sublayer 16*c*. As described, the bump 16A having the gold-plated sublayer 16*b* on top is structured in various ways.

When the head chip 12 above the nozzle sheet 11 is arranged in a predetermined position, the top sublayer of the bump 16A attached to the nozzle sheet 11 and the pad 12*c* of the head chip 12 are opposed, and at least in contact with each other.

Figure 9:
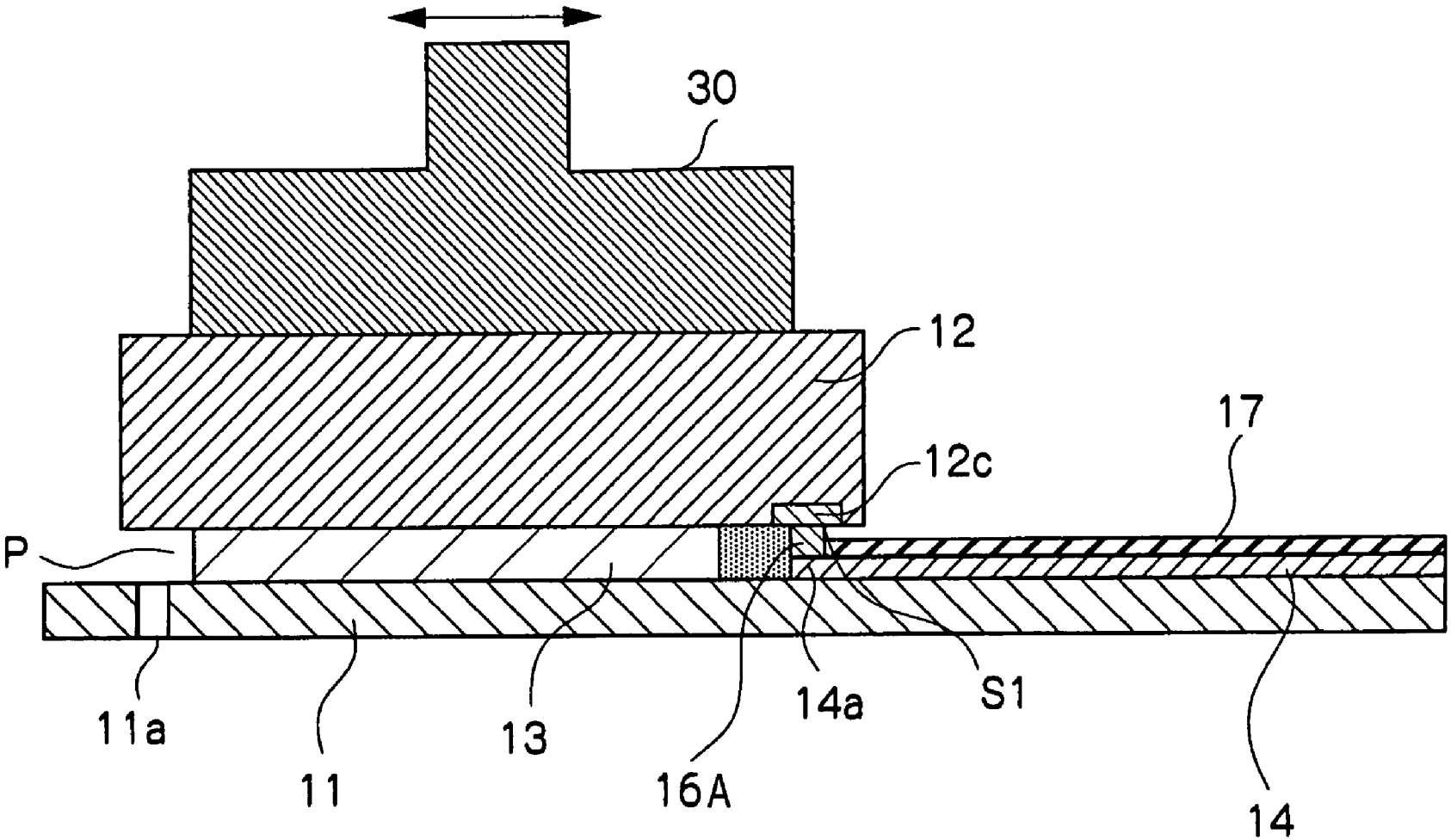
FIG. 9 is a front cross-sectional view showing ultrasonic bonding of a pad of the head chip and the bump.

FIG. 9 is a front cross-sectional view showing ultrasonic bonding of the pad 12*c* of the head chip 12 and the bump 16A. In FIG. 9, a vibrator 30 of an ultrasonic transmitter (not shown) is placed on the head chip 12 for creating ultrasonic vibration (reciprocating vibration indicated by the arrow in FIG. 9). The ultrasonic vibration created is transmitted via the head chip 12 to the bump 16A.

This compresses the bump 16A by α until its height becomes equal to the thickness L4 of the barrier layer 13, whereas the gold-plated sublayer 16*b* on top of the bump 16A and the pad 12*c*, which is made of aluminum and included in the head chip 12, are bonded together by ultrasonic bonding (metal bonding) at a contact surface S1.

Figure 10:
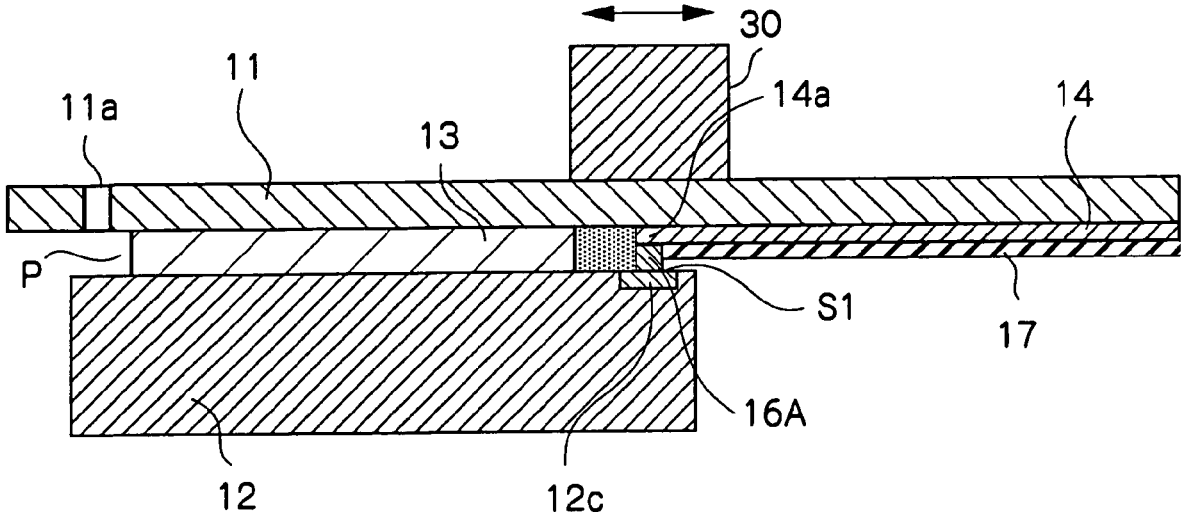
FIG. 10 is a front cross-sectional view showing another bonding method different from that illustrated in FIG. 9.

FIG. 10 is a front cross-sectional view showing a bonding method different from that illustrated in FIG. 9. Although FIG. 10 shows ultrasonic bonding similarly to FIG. 9, the position of vibration source is different from that in FIG. 9. Referring to FIG. 10, the vibrator 30 opposes the head chip 12 with the nozzle sheet 11 interposed therebetween and is positioned above the bump 16A. To perform ultrasonic bonding, ultrasonic vibration is applied to the nozzle sheet 11 and then transmitted to the bump 16A.

Subsequent to the ultrasonic bonding of the pad 12*c* and the bump 16A, the bonded part is covered and sealed with the sealant 18 such as resin (see FIG. 1). This is to prevent the bonded part from being exposed to the air and from absorbing moisture. In the present embodiment, where.

aluminum (pad 12*c*) and gold (bump 16A) having different ionization tendencies are bonded together, absorption of moisture might cause aluminum to melt (galvanic corrosion) since aluminum has a higher tendency to ionize. Sealing of the bonded part is required for this reason.

Figure 11:
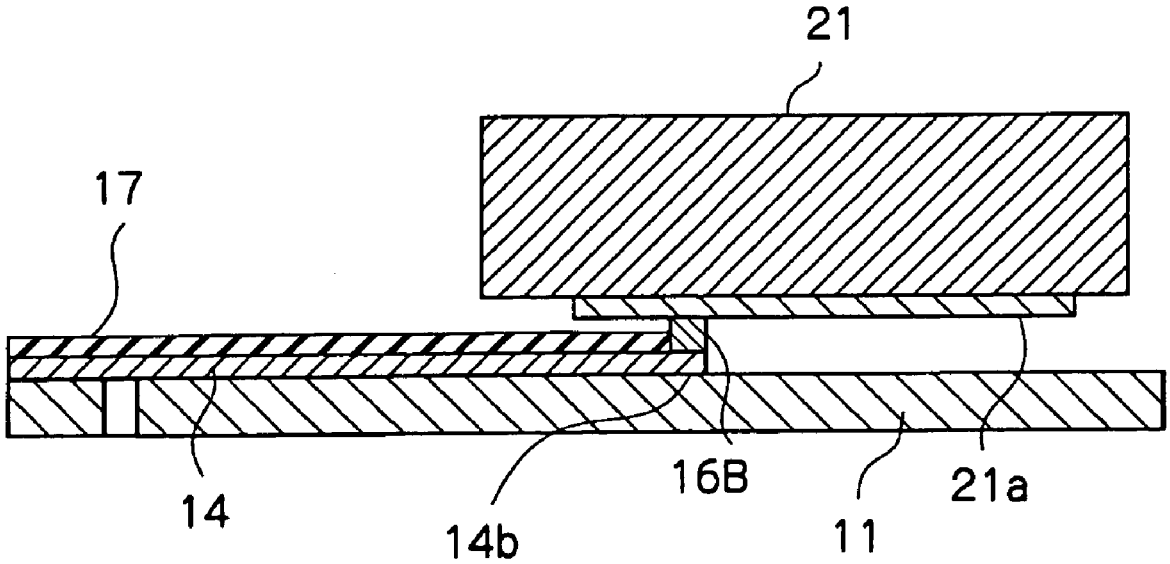
FIG. 11 is a front cross-sectional view showing bonding between a wiring layer on the nozzle sheet and the printed circuit board.

FIG. 11 is a front cross-sectional view showing bonding between the wiring layer 14 disposed on the nozzle sheet 11 and the printed circuit board 21. The printed circuit board 21 has the wiring layer 21*a* on the surface opposing the nozzle sheet 11. The wiring layer 21*a* includes a copper wiring sublayer, a nickel-plated sublayer (foundation sublayer) formed on the copper wiring sublayer, and a gold-plated sublayer formed further on the nickel-plated sublayer.

On the other hand, the bump 16B similar to that used in bonding to the head chip 12 is provided on the second terminal 14*b* of the wiring layer 14 disposed on the nozzle sheet 11. The bump 16B has the same layer structure as that of the bump 16A illustrated in one of FIGS. 6 to 8.

The top sublayer (gold-plated sublayer) of the wiring layer 21*a* is in contact with the bump 16B on the second terminal 14*b*. Similarly to the case of the head chip 12, the vibrator 30 is placed on the upper surface (in FIG. 11) of the printed circuit board 21, or on the lower surface (in FIG. 11) of the nozzle sheet 11 for creating ultrasonic vibration. The ultrasonic vibration created is then transmitted to the bump 16B so as to bond it to the wiring layer 21*a* disposed on the printed circuit board 21 by ultrasonic bonding.

There are other possible bonding methods in addition to those described above.

In FIG. 11, for example, the wiring layer 21*a* on the printed circuit board 21 is formed of a copper wiring sublayer overlaid with a solder-plated sublayer.

Moreover, the one formed on the second terminal 14*b* of the wiring layer 14 disposed on the nozzle sheet 11 is (1) the bump 16B having the gold-plated sublayer on top, similarly to the above, or (2) the projected solder-plated sublayer.

Then the top sublayer (solder-plated sublayer) of the wiring layer 21*a* is solder-bonded to the bump 16B or the solder-plated layer on the second terminal 14*b* by, for example, applying pressure through reflowing or a heat bar. The wiring layer 21*a* on the printed circuit board 21 is thus bonded to the wiring layer 14 on the nozzle sheet 11.

The bonding between the wiring layer 14 on the nozzle sheet 11 and the printed circuit board 21 may be performed either prior to or subsequent to the ultrasonic bonding between the bump 16A on the wiring layer 14 disposed on the nozzle sheet 11 and the pad 12*c* of the head chip 12. When using ultrasonic bonding, the bonding between the bump 16B on the wiring layer 14 disposed on the nozzle sheet 11 and the wiring layer 21*a* disposed on the printed circuit board 21, may be performed simultaneously with the bonding between the bump 16A on the wiring layer 14 disposed on the nozzle sheet 11 and the pad 12*c* of the head chip 12.

In the present embodiment, as described above, the head chip 12 and the printed circuit board 21 can be electrically connected without providing openings on the nozzle sheet 11. Since the projections, which are created on the openings after sealing, are thus eliminated, the ink ejecting surface (lower surface in FIG. 1) of the nozzle sheet 11 can be smoothed out.

In the present embodiment, moreover, only the pad 12*c* made of aluminum is disposed on the head chip 12 and no gold-plated layer is provided. This eliminates the process for forming the gold-plated layer on the pad 12*c* and thus can reduce the production cost.

On the other hand, ultrasonic bonding to the wiring layer 14 on the nozzle sheet 11 requires the gold-plated layer to be formed on the first terminal 14*a* of the wiring layer 14. Therefore, the bump 16A can be formed in the process for forming the gold-plated layer on the first terminal 14*a* of the wiring layer 14, and no additional process is required. Ultrasonic bonding can thus be performed without raising the production cost.

As described above, the height of the bonded part between the head chip and the wiring layer constitutes the height of the ink chamber. Further, since bonding to the head chip requires no opening on the nozzle sheet, the process for sealing the openings can be eliminated. Accordingly, the projections created by sealing and on the surface of the nozzle sheet are eliminated, and the plane surface can thus be maintained.

What is claimed is:

1. An ink ejecting head comprising:

a nozzle sheet having nozzles for ejecting droplets;

a head chip having an energy generator opposing each of the nozzles;

a chamber-forming member interposed between the nozzle sheet and the head chip for defining the space for a liquid chamber between the energy generator and the nozzle;

an electrode provided in a surface of the head chip, the surface opposing the nozzle sheet, and provided in at least a part of an area where no chamber-forming member is disposed;

a wiring layer having a first terminal and disposed on a surface of the nozzle sheet, the surface adjacent to the head chip; and a bonding layer disposed on the first terminal of the wiring layer and being at least in contact with the electrode of the head chip;

wherein the energy generator applies energy to liquid in the liquid chamber for ejecting the liquid from the nozzle; and wherein the bonding layer and the electrode of the head chip are bonded by ultrasonic bonding.

2. The ink ejecting head according to claim 1, further comprising:

a second bonding layer; and a printed circuit board;

wherein the wiring layer has a second terminal, the second bonding layer is disposed on the second terminal, and the head chip and the printed circuit board are electrically connected via the wiring layer by bonding the second bonding layer to the printed circuit board.

3. The ink ejecting head according to claim 1, further comprising:

an insulating layer disposed on at least a part of an area on the wiring layer disposed on the nozzle sheet, the area excluding the area of the first terminal.

4. The ink ejecting head according to claim 1, wherein the bonding layer has a sublayer, and the sublayer and the wiring layer comprises the same material.

5. The ink ejecting head according to claim 1, wherein the bonding layer includes a plurality of sublayers, and a top sublayer of the plurality of sublayers comprises elemental gold or a gold alloy.

6. The ink ejecting head according to claim 1, wherein the electrode, the first terminal of the wiring layer, and the bonding layer are sealed with sealant.

7. A method for making an ink ejecting head comprising a nozzle sheet having nozzles for ejecting droplets; a head chip having an energy generator opposing each of the nozzles; a chamber-forming member interposed between the nozzle sheet and the head chip for defining the space for a liquid chamber between the energy generator and the nozzle; an electrode provided in a surface of the head chip, the surface opposing the nozzle sheet, and provided in at least a part of an area where no chamber-forming member is disposed; and a wiring layer having a first terminal and disposed on a surface of the nozzle sheet, the surface adjacent to the head chip; comprising the steps of:

forming a bonding layer on the first terminal of the wiring layer disposed on the nozzle sheet, the bonding layer having a height at least to be in contact with the electrode of the head chip when the head chip is mounted;

stacking the nozzle sheet, the chamber-forming member, and the head chip in layers such that the electrode of the head chip is brought into contact with the bonding layer on the first terminal of the wiring layer; and bonding the electrode of the head chip to the bonding layer, by applying ultrasonic vibration to the head chip or the nozzle sheet.

8. The method for making the ink ejecting head according to claim 7, the wiring layer has a second terminal, further comprising the steps of:

forming a second bonding layer on the second terminal of the wiring layer; and electrically connecting the head chip and the printed circuit board via the wiring layer by bonding the printed circuit board and the second bonding layer.

* * * * *